United States Patent [19]

Troth

[11] 3,941,300

[45] Mar. 2, 1976

[54] FOLDED PLASTIC CONTAINER WITH SNAP LID

[75] Inventor: John S. Troth, Wilmington, Del.

[73] Assignee: Pamark, Inc., Montchanin, Del.

[22] Filed: July 19, 1974

[21] Appl. No.: 490,049

[52] U.S. Cl. ..... 229/5.5; 220/307; 222/153

[51] Int. Cl.[2] ..... B65D 5/12

[58] Field of Search ..... 229/5.5, 43, 9, 11, 19, 229/20; 220/306, 307 X; 150/.5; 40/156

[56] References Cited

UNITED STATES PATENTS

| | | | |
|---|---|---|---|
| 2,077,173 | 4/1937 | Holy | 229/5.5 |
| 3,317,109 | 5/1967 | Palmer | 229/5.5 |
| 3,370,757 | 2/1968 | Foster | 222/153 |
| 3,530,981 | 9/1970 | Weimecke, Jr. | 220/307 X |

FOREIGN PATENTS OR APPLICATIONS

| | | | |
|---|---|---|---|
| 1,217,849 | 12/1959 | France | 215/349 |

*Primary Examiner*—Davis T. Moorhead
*Attorney, Agent, or Firm*—Paul & Paul

[57] ABSTRACT

A container constructed of plastic or like materials is provided which is generally constructed of three separate pieces in a rectangular form. Four sides of the container are constructed of a single sheet of plastic which has been folded into a sleeve form while the remaining two surfaces are constructed of formed plastic or the like. The formed pieces snap fit into the sheet plastic portion. The container is ideally made entirely of clear plastic and enjoys the property of being easily assembled. The container cannot be disassembled without applying appropriate external forces; a substantially greater force is required to disassemble the container than is required to assemble it.

18 Claims, 7 Drawing Figures

FOLDED PLASTIC CONTAINER WITH SNAP LID

BACKGROUND OF THE INVENTION

1. Field of the Invention

This invention pertains to plastic and like containers and more particularly to plastic sleeve-type containers having end pieces for locking engagement therewith.

2. Description of the Prior Art

In the prior art, numerous folding cartons are present for packaging various kinds of goods to be sold to consumers. Paperboard or cardboard has long been used to manufacture such containers and the formation of paperboard or cardboard containers by assembling them from folded blanks along preformed fold lines has become a highly developed and most sophisticated art. The cardboard or paperboard type of container is advantageous from several standpoints. It can be rapidly manufactured and in fact it has been known to process blanks of cardboard or paperboard into boxes or containers at a rate of 120,000 per hour. Additionally, cardboard or paperboard is most amenable to the receipt of printed matter from high speed printing presses. This permits the use of advertising, pictorial representation, and other indicia relating to the product contained in the package to be placed on the surface of the package. The characteristic of the paperboard to absorb ink has made it most amenable to such use.

More recently, a number of factors have come into play which have made clear plastic containers more desirable than paperboard or cardboard for the storage and display of consumer products. One factor is that diminishing supplies of pulpwood have resulted in shortages of cardboard and paperboard, necessitating a search of substitutes for cardboard and paperboard as packaging materials. Another factor is that sale of small goods in a loose or bulk format has become increasingly more expensive as such goods are most vulnerable to pilfering in the store. Accordingly, it has been desired to place such goods in individual packages and have the goods be visible so that they may be sold in a supermarket type of format, while the goods are not amenable to being easily placed in the pocket of a purchaser due to the clear plastic packages they are sold in. Still further, the waterproof and liquid resistant characteristics of many plastics, particularly those of the polyvinylchloride class, have made these materials most desirable for the containment of small consumer goods such as cigarette lighters. All of the above factors have contributed to the substantial displacement of cardboard and paperboard containers by clear plastic containers for small items.

The small plastic containers which have been used heretofore have overcome a number of these above enumerated problems. However, certain problems have been inherent in the small plastic containers themselves. Specifically, the containers have been difficult to assemble and have not been amenable to snap-on type of closures. Furthermore, many of the containers which have been used do not have a pleasing appearance to the eye and utilize bulky closure devices which tend to hide the contents of the container. Some containers have had their closure portions constructed of cardboard. This has required that the containers be properly oriented in order to most attractively display the goods contained therein in a retail store. Additionally, some prior art devices have utilized two or three portions, each folded of a plastic sheet, secured together by interlocking tabs. These boxes have been difficult to assemble and have not been readily reassembleable in a store, after they may have been disturbed. A further disadvantage present in much of the prior art is that the prior art containers are expensive to manufacture, thus making it difficult for clear plastic containers to compete effectively with other brands of packages.

Foldability of plastic sheets, such as are used in the present container, has been a problem and has been addressed by the invention of U.S. Pat. No. 3,727,825, issued to me. The disclosure of that patent is hereby incorporated herein by reference.

It has also been known to manufacture a folded plastic container from a single sheet of clear plastic; such a container is shown in my U.S. Pat. No. 3,746,242. The disclosure of that patent is also hereby incorporated herein by reference. Boxes such as those of my U.S. Pat. No. 3,746,242 must be assembled by folding the portions together and indeed, in many aplications, are most appropriate. However, it is sometimes desired to have a box which is easily assembleable and disassembleable by snap-on lids. The choice of container is dictated largely by the kind of product that the box will be required to contain in a store and by the environment in which the product will be sold.

SUMMARY OF THE INVENTION

The present invention is directed towards providing a solution to the above enumerated and other problems by providing a container utilizing at least one portion of sheet plastic construction and having at least one end of a formed or molded construction which end can be snapped into engagement with said folded plastic portion and be removed from engagement with said folded plastic portion.

It is another object of the present invention to accomplish the above object wherein the folded sheet portion has a plurality of tabs extending therefrom for snap interlocking with the formed or molded end portion.

It is a further object of the present invention to accomplish both of the above objects, wherein the folded plastic sheet portion snaps into engaged relation with two of said formed end portions.

It is a further object of this invention to accomplish all of the above objects, wherein the container is manufactured of a transparent material, thereby allowing for the external observation of the item contained in the container.

It is another object of this invention to provide a novel combination container wherein one component is of folded sheet material construction, folded in a sleeve like arrangement, wherein two components of the container are of formed material construction suitably disposed to receive snap tabs to fit in secure engagement with the sheet plastic component, whereby the container, by engaging the end portions with the clear sheet portions, can be easily closed and can be opened but can only be opened with greater difficulty than is involved in closing the container.

Other objects and advantages of the present invention will become readily apparent to those skilled in the art from a reading of the following brief description of the drawing figures, detailed descriptions of the preferred embodiments and the appended claims.

DESCRIPTION OF THE PREFERRED EMBODIMENT

Figure 1:
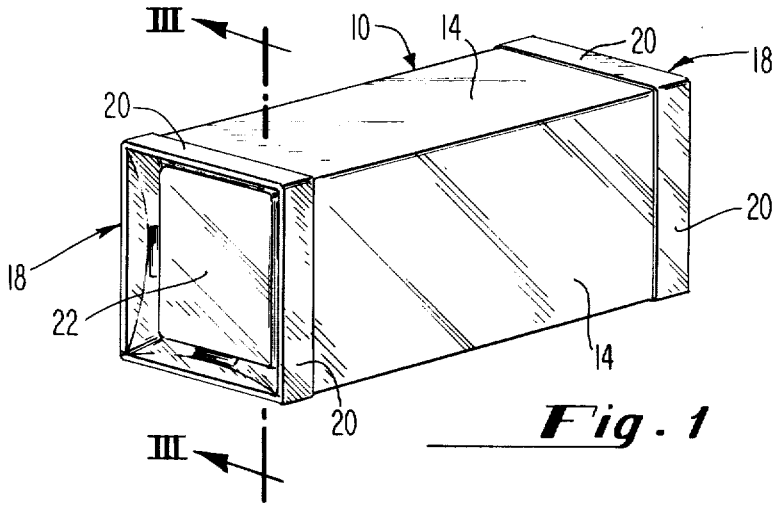
FIG. 1 is a perspective view of the container of the present invention.

Reference is made to FIG. 1 where the container with snap lid of the present invention is shown in a perspective view. The embodiment of the container illustrated comprises three pieces, a folded sheet plastic, vinyl or like sleeve designated generally as 10 and two vacuum-formed plastic, vinyl or the like pieces forming the ends of the container, designated generally as 18. The folded sleeve has panels 14 which are the sides or outer surfaces of the basic configuration into which the sheet 10 has been folded. The end portions 18 are preferably molded or vacuum-formed or injection molded or otherwise shaped and have flanges 20 which are are designed for suitable close fitting around the panels 14 of the sleeve at ends thereof. Each piece 18 also has a generally transverse center portion designated generally as 22 which substantially forms the ends or caps of the folded plastic container.

Figure 2:
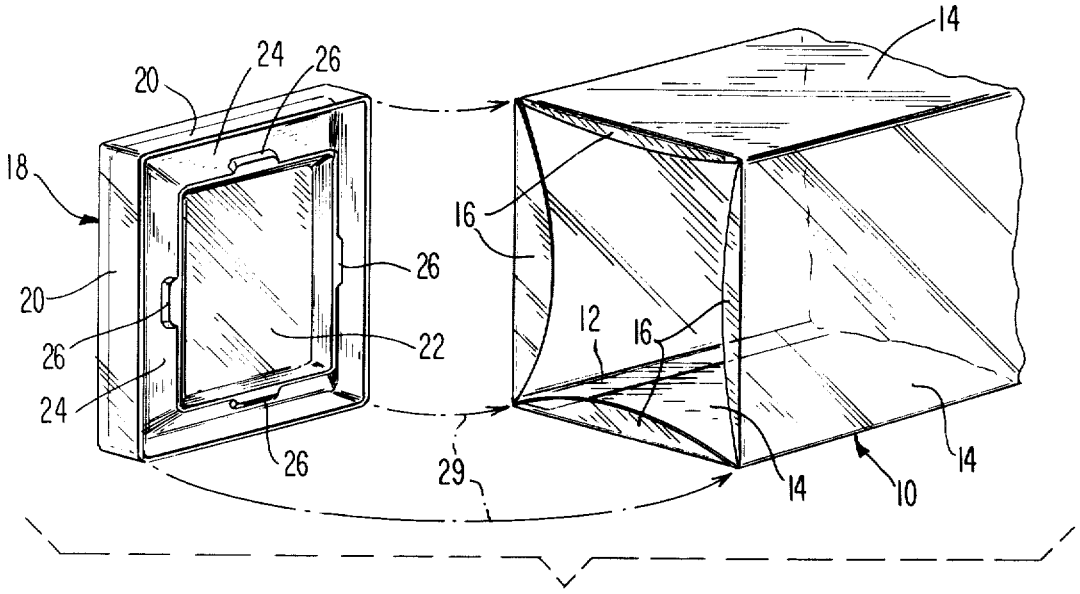
FIG. 2 is a fragmentary perspective view showing a portion of container of the present invention with an end closure member in disassembled condition.

Reference is now made to FIG. 2 where the structure of the sleeve 10 and the end piece 18 are again shown. One end of the container is shown disassembled from the sleeve. As noted, the sleeve is fabricated by first appropriately scoring a piece of sheet plastic or the like. The sheet plastic is die cut to size and then bent on the scores so as to form the surfaces 14, the extension tabs 16 and the folding seam tab 12. The folding seam tab 12 is then secured to an appropriate panel 14 by any suitable means such as a heat seal, glue, transparent tape and the like, all of which are well known in the plastic fabricating arts. The folded sheet plastic sleeve 10 has a number of extension tabs 16 which extend from the surfaces 14. Each tab is bent inwardly, so that the tabs may face towards one another. Before they are bent the extension tabs 16 are continuous extensions of the panels 14. The tabs 16 may be bent inwardly in a processing operation or can be left as straight extensions of the panels 14, to be bent inwardly by contact with an end cap 18 upon the initial assembly of the cap 18 onto an end of the sleeve 10, or can be bent at any other time, by any technique.

The vacuum formed or molded plastic, vinyl or the like piece 18 which forms the end or cap or bottom or top of the container, these terms all being used interchangeably herein, has a shape generally of a polygon having the same number of sides as there are number of panels 14 of the folded sleeve 10. Each piece 18 has a flange 20 extending completely around piece 18 and has a center portion 22 which also is a polygon having the same number of sides as there are to the piece 18. Angularly disposed connecting structure 24 connects the center portion 22 to the flange 18. Outwardly directed nibs 26 are integrally disposed on the connecting structure 24; these nibs or protrusions serve to lockingly engage the edges of the extension tabs 16 of the sleeve 10, when the container of the present invention is in its assembled condition.

The container of the present invention is assembled by pushing the end pieces 18 into engagement with the sleeve 10, with the end piece 18 being moved in the direction of the arrows 29 indicated in FIG. 2.

Figure 4:
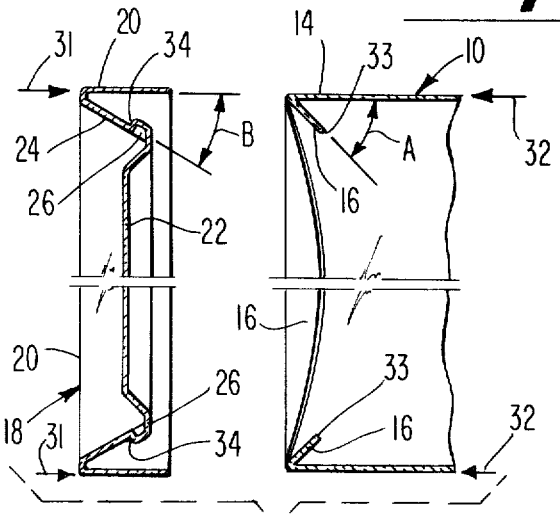
FIG. 4 is a fragmentary exploded longitudinal sectional view taken generally along the line III—III of FIG. 1, showing the container and its end closure in disassembled condition.
Figure 3:
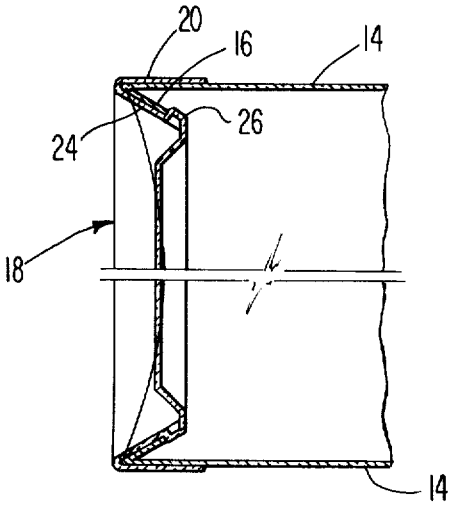
FIG. 3 is a fragmentary longitudinal sectional view of the container of the present invention taken generally along the line III—III of FIG. 1, showing the container and its end closure in assembled condition.

FIG. 3 and FIG. 4 together illustrate the means by which an end piece 18 and the sleeve 10 are retained together when the container of the present invention is in its assembled condition. FIG. 3 is a sectional view illustrating the piece 18 and the sleeve 10 in the assembled condition of the container while FIG. 4 shows sectional views, taken along the same section line as FIG. 3, of the piece 18 and the sleeve 10 when the container of the present invention is in its disassembled condition.

FIG. 4 shows each of the extrusion tabs 16 bent away from its corresponding integrally connected panel 14 of the sleeve 10 at an angle which has been designated as A. In practice, it has been found that angle A should be in the neighborhood of 45°. The precise size of angle A is not important, rather what is important is the relationship between angle A and an angle B. Angle B is the angle between the connecting structure 24 and the flange 20 of the end piece 18, which is formed when the piece 18 is drawn or molded. In practice, the piece 18 has been preferably vacuum formed with angle B in the neighborhood of 30°; again, what is important is not the precise size of angle B but rather the relationship between the size of angle A and the size of angle B. The center portion 22 and two oppositely directed ones of the four nibs 26 of the piece 18 are also shown in FIG. 4.

The sleeve 10 is formed of any suitable plastic, vinyl or the like having sufficiently rigid form and having the characteristic of memory; that is, once the sheet plastic has been formed to a given angle, such as angle A, deflection of the sheet plastic structure so as to change angle A will result in the sheet plastic structure attempting to return to its configuration and regain the angle A.

The piece 18 is formed by conventional techniques which are well known in the plastic, vinyl and the like fabrication arts. It is to be understood that the piece 18 is formed by vacuum forming, molding, by injection or other techniques, etc. rather than folded as is the sleeve 10, because piece 18 must be made to attain the proper geometric relation between flange 20, center portion 22 and the nibs 26.

The present invention is assembled by pushing the piece 18 into engagement with the sleeve 10, thus moving these pieces in the relative directions indicated by the arrows 31, 32 in FIGS. 2 and 4. When the piece 18 is first placed in contact with the sheet plastic sleeve 10, the extension tabs 16 will be contacted by the nibs 26. As piece 18 is pushed onto sleeve 10, flange 20 fits closely around the outer surfaces of the panels 14 and the nibs 26 effect a camming action so as to deflect the extension tabs 16 outwardly toward their respectively connected panels 14 thus causing a decrease in angle A. As the piece 18 is further pushed into full engagement with sleeve 10, the nibs 26 travel past the tips 33 of the extension tabs 16 whereupon extension tabs 16 then seek to return to their prior position such that angle A is returned toward its original size. As the extension tabs 16 move outwardly towards their original position, thus increasing the size of angle A, the extension tabs 16 contact the connecting structure 24 and their edges 33 enter into abutting engagement with transverse nib ledges 34. The connecting structure 24, being rigidly retained by center portion 22 and flange 20 of the piece 18, prohibits further outward movement of the extension tabs 16 and angle A will remain in the neighborhood of 30° or about the same size as angle B. At this point, the sleeve 10 and the end piece 18 are in the engaged relation shown in FIG. 3. The piece 18 is secured to the sleeve 10 by the nib ledges 34 which lockingly engage the edges 33 of the extension tabs 16. This prevents the end piece 18 from moving relative to sleeve 10.

It is to be understood that the container of the present invention may be disassembled by removing the piece 18 from engagement with the sleeve 10, thus changing the configuration shown in FIG. 3 to the configuration shown in FIG. 4. Such disassembly can be affected by grasping the panels 14 with one hand, grasping the flange 20 with the other hand and forcibly separating piece 18 from the sleeve 10. Due to the contacting relation between the nib 26 and the extrusion tabs 16 when the container is in the assembled condition shown in FIG. 3, it is to be understood that substantially more force is required to disassemble the container than is required to assemble it, principally to force the tab edges 33 off the nib ledges 34. Upon disassembly, the tabs 16 spring out from their respective surfaces 14 and angles A are again approximately 45°; due to the memory characteristic of the material used to manufacture the sleeve 10, discussed above. Accordingly, the container of the present invention can be assembled and disassembled many times, and substantially the same force is required each time it is assembled. Another, different, substantially greater constant force is required each time it is disassembled.

It is to be understood that in the preferred embodiment of the present invention, which is illustrated in FIGS. 1, 2, 3 and 4, the end pieces 18 are interchangeable and can be engaged with either end of the sleeve 10. It is further to be understood that in the preferred embodiment of the invention, each panel 14 of the sleeve 10 can mate with any planar portion of the flange 20 and the corresponding connecting structure 24 and with any of the nibs 26 of the end piece 18. Specifically, the end piece 18 illustrated in FIG. 1 could be removed from the sleeve 10, rotated 90° or 180° or 270° and then reengaged with the sleeve, without any substantial change in the container.

It is also to be understood that the container of the present invention can be manufactured in a number of configurations and that the sleeve 10 need not be formed as a structure with identical sides. Specifically, the sleeve could have sides of unequal size with the end 18 affixed thereto in such a manner that the plane of the center portion 20 of end piece 18 was not perpendicular to all of the surfaces 14 of the folded sheet plastic sleeve 10. Additionally, the sheet plastic sleeve 10 can be made in a round, cylindrical, conical, or frusto-conical configuration, so that there is only one panel 14, that having a continuous curved outer surface. The sleeve 10 could also be folded with different numbers of sides or panels 14. Specifically, the sleeve could be folded with three, five, six, seven, etc. sides, there being possible as many sides as the fabricator desires and in each instance the end piece will have a similar number of sides. While it is desirable to have at least one nib on each connecting structure 24 to retain an extension tab which extends from any appropriate panel of the sleeve, it will be understood that in some instances fewer, or even a greater number of nib-tab connections than the number of panels that comprise the sleeve will be desirable. Moreover, in some instances the end piece and sleeve may be hingedly connected, either integrally one-piece or as two fastened pieces, with one or more nib-tab locking arrangements for the end piece.

It will also be understood that the container of the present invention can be assembled using only one end piece 18 in conjunction with the folded sheet plastic sleeve 10. This will produce a container having an open top.

In practice, the container has been manufactured by making the folded sheet plastic sleeve 10 from a polyvinylchloride material. Polyvinylchloride is very suitable for this application because of its "snap-back" or "memory" characteristic, whereby once it is formed to a given shape, it seeks to retain that shape when forces are applied which deflect it away from that shape or configuration. This memory characteristic, in combination with the nib-engagement feature provides for the snap open and snap close characteristic of the present container. Polyvinylchloride has proven to be tough, permitting the container to be opened and closed many times and has proven to accept repeated folding, without breakage and without loss of the memory characteristic.

The end pieces 18 are formed by vacuum forming, molding or other suitable methods. Such manufacture of the end pieces 18 results in a substantial cost saving over, for example, injection molded lids or end pieces and has proven to be very successful in the rapid production of large numbers of substantially identical pieces 18. The end piece 18 is preferably manufactured from 0.010 to 0.040 inch thick polyvinylchloride, depending upon the size of the container.

In constructing the sleeve, folded sheet plastic sleeve 10 is preferably die cut from single plastic sheet of 0.005 to 0.015 inch or heavier polyvinylchloride and is then scored and bent to the proper shape. The seam tab 12 is then secured, thus holding the folded sheet plastic sleeve in its proper folded, assembled condition.

Although the invention has proven to be successful when the fabrication techniques and materials described above have been used, it is to be understood that the folded plastic container could be manufactured of any number of different plastic materials or even of paper, cardboard, metal (especially the sleeve), and still be within the spirit and scope of the present invention described in the appended claims. Other modifications and changes in manufacture, all within the scope of the invention as described in the specification herein and in the appended claims will be apparent to those of ordinary skill in the art from an inspection of the attached drawings, a reading of this specification and study of the appended claims.

Figure 5:
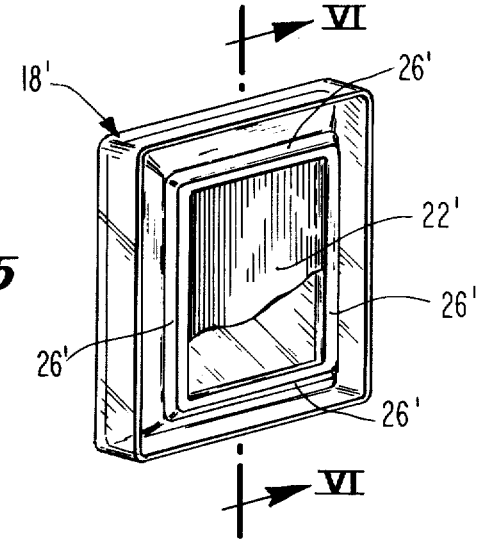
FIG. 5 is a perspective of an alternative end cap in accordance with this invention.

With reference to FIG. 5 of the drawings, there is illustrated a modified form of end cap, generally designated by 18'. The end cap 18' is constructed generally similarly to that 18 illustrated in FIG. 2, of substantially the same range of materials, by substantially the same techniques, and having the same general structural configuration, except that the nibs 26' generally extend across the linear edge of the circumference of the central portion 22' thereof, such that the four (4) nibs 26' circumscribe the center portion 22'.

Figure 6:
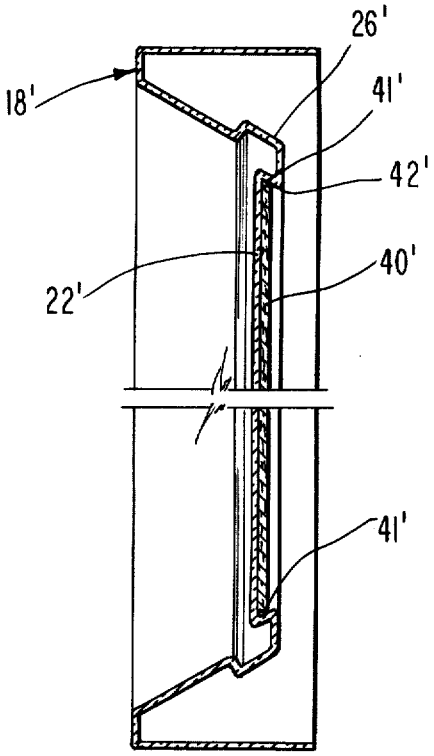
FIGS. 6 and 7 are, respectively, enlarged sectional views taken through the cap of FIG. 5, generally along the line of VI—VI, but wherein alternatively positioned inserts are illustrated.

With particular reference to FIG. 6, it will be seen that the transparent plastic center portion 22' has disposed thereagainst, and inwardly thereof, a cardboard (or other suitable materials of construction) panel member 40', with it's peripheral edges in engagement within peripheral undercut portion 41' of the nibs 26', as illustrated in FIG. 6. Thus, indicia, advertising or the like can be placed upon the cardboard or other suitable panels 40', which will be inside the container in the embodiment of FIG. 6, but which will be readily visible through the transparent center portion 22' of end cap 18'. It will be apparent suitable indicia may be utilized, embodying colorings, lettering, instructions, as desired. It will also be apparent that the member 40' may be snapped-in, into the position illustrated in FIG. 6 being snapped-over the inwardly-directed lips 42' of the nibs 26'.

Figure 7:
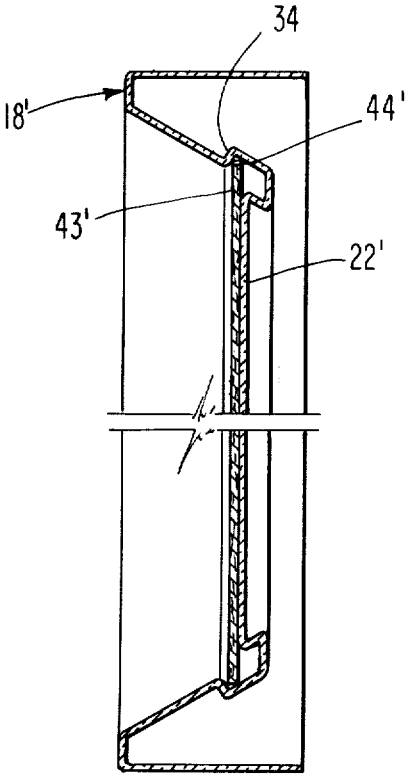

With reference to FIG. 7, the end cap 18' of FIG. 6 is illustrated, but without the panel 40', but with an alternative (or additional, if desired,) panel 43', disposed on the outer surface of center portion 22' snapped into engagement inside the nib portions 26', with the peripheral edges of the panel 43' in engagement with inwardly bent ledge portions 44', opposite the ledges 34 discussed above, as illustrated in FIG. 7. The panels 43' may also bear suitable indicia, instructions, designs, etc., and may be disposed into the container cover 18' even after assembly of the cover 18' relative to the container.

What is claimed is:

1. A closable container of the re-openable type comprising a sleeve-like container portion and a separate closure portion, at least said container portion being formed of resilient plastic material having memory properties, said closure portion being adapted for generally transverse disposition at an end of said container portion, and at least one set of snap type locking means for removably securing said closure portion into closed engagement relative to said container portion under a greater opening force than closing force, said locking means comprising:

a. tab means of said container member, with a base portion of said tab means being carried by a wall portion of said container portion at an end portion of said container portion, with said tab means having an initial disposition with said wall portion when said closure portion is in unassembled disposition relative to said container portion, and terminating in a free tab edge of a width adapted when directed longitudinally inwardly of said container portion to extend to a predetermined depth from the adjacent end of said container portion, and b. protrusion means carried by said closure portion and disposed within said container portion and being directed toward said wall portion of said container portion when said closure portion is in assembled disposition relative to said container portion, said protrusion means defining ledge means located at substantially said predetermined depth from the adjacent end of said container portion when said closure portion is in assembled disposition relative to said container portion, said ledge means facilitating abutting engagement with said free tab edge, said closure means having flange means in overlying relation to an outer surface portion of a container wall portion at said end of said container portion adjacent said closure portion, said initial disposition of said tab means being longitudinally into said container portion at a first acute angle, with the free tab edge being directed an of said container portion to said predetermined depth in the unassembled disposition of the closure portion relative to the container portion, said protrusion means having camming surface means facing toward an opposite end of said container portion, whereby said tab means is resiliently displaceable to a position at a second acute angle with said wall portion after assembly of said closure portion and container portion into closed disposition; said second acute angle being no greater than said first acute angle, said tab means being adapted to be moved toward an lesser angle than said second angle in response to ana opening force applied to separate said closure and container portions.

2. The container of claim 1, wherein said closure portion has a central portion that is in recessed relation relative to the adjacent end of said container portion when said closure portion and container portion are assembled.

3. The container of claim 2, wherein said flange means is disposed in overlying relation to an outer surface portion of the container portion, entirely about the periphery of an end portion of said container portion, when said closure portion and container are in assembled disposition.

4. The container of claim 1, wherein said container portion is sleeve-like, of generally rectangular configuration and wherein said closure portion is of mating rectangular configuration.

5. The container of claim 4, wherein there are four said locking means, for locking engagement of said closure portion with each wall of said container portion.

6. The container of claim 1, wherein said container portion is constructed of material that is substantially transparent.

7. The container of claim 1, wherein said closure portion is constructed of material that is substantially transparent.

8. The container of claim 1, wherein both said container portion and said closure portion are constructed of material that is substantially transparent.

9. The container of claim 1, wherein a said closure portion of provided for both opposite ends of said container portion.

10. The container of claim 8, wherein said container portion and said closure portion are of thermoplastic material construction.

11. The container of claim 1, wherein said tab means is initially generally coplanner with said wall portion and is moveably disposable inwardly thereof upon assembly of said closure portion and said container portion.

12. The container of claim 1, including separate insert panels means in engagement with said nib means along an inside portion of said closure portion.

13. The container of claim 1, including separate insert panel means in engagement with said nib means along an outside of said closure portion.

14. The container of claim 1, including separate insert panel means in engagement with said nib means, along a generally transverse portion of said closure portion, and with said panel having indicia means thereon.

15. A closable container of the re-openable type comprising a sleeve-like container portion and a closure portion, said closure portion being adapted for generally transverse disposition at an end of said container portion, and at least one set of snap type locking means for securing said closure portion into closed engagement relative to said container portion under a greater opening force than closing force, said locking means comprising:

a. tab means of said container member, with a base portion of said tab means being carried by a wall portion of said container portion at an end portion of said container portion, with said tab means having an initial disposition with said wall portion when said closure portion is in unassembled disposition relative to said container portion, and terminating in a free tab edge of a width adapted when directed longitudinally inwardly of said container portion to extend to a predetermined depth from the adjacent end of said container portion, said initial disposition of said tab means being longitudinally into said container portion at a first acute angle, with the free tab edge being directed inwardly of said container portion to said predetermined depth in the unassembled disposition of the closure portion relative to the container portion, and b. protrusion means carried by said closure portion and disposed within said container portion and being directed toward said wall portion of said container portion when said closure portion is in assembled disposition relative to said container portion, said protrusion means defining ledge means located at substantially said predetermined depth from the adjacent end of said container portion when said closure portion is in assembled disposition relative to said container portion, said ledge means facilitating abutting engagement with said free tab edge, said closure means having flange means in overlying relation to an outer surface portion of a container wall portion at said end of said container portion adjacent said closure portion, wherein said protrusion means has camming surface means facing toward an opposite end of said container portion, and whereby said tab means is resiliently displaceable to a position at a second acute angle with said wall portion after assembly of said closure portion and container portion into closed disposition, with said second acute angle being no greater than said first acute angle, and wherein said closure portion has a central portion that is in recessed relation relative to the adjacent end of said closure portion when said closure portion and container portion are assembled, wherein said flange means is disposed in overlying relation to an outer surface portion of the container portion, entirely about the periphery of said container portion when said closure portion and container are assembled, wherein said container portion and closure portion are comprised of separate elements, wherein said container portion is sleeve-like, of generally rectangular configuration and wherein said closure portion is of mating rectangular configuration, wherein there are four said locking means, for locking engagement of said closure portion with each wall of said container portion, wherein both said container portion and said closure portion are constructed of material that is substantially transparent, and wherein said container portion and said closure portion are of thermoplastic material construction.

16. A plastic container comprising:

a. a first piece of plastic, said first piece being a piece of folded sheet plastic, said first piece comprising:

i. a plurality of surfaces, the number of said plurality of surfaces being denominated as N;

ii. N extension tabs, one each of said N tabs extending from each one of said N surfaces;

iii. A folding seam tab;

b. a second piece of plastic, said second piece being of vacuum formed construction and having the shape of a polygon having N sides, said second piece comprising:

i. a flange, said flange having N sides and being suitably disposed for contacting relation with said N surfaces of said first piece, each of the N sides of said flange being suitably disposed for contact with any one of said N surfaces of said first piece;

ii. a center portion, said center portion being suitably disposed for insertion within said N surfaces of said first piece, when said container is in its assembled condition, in an orientation such that said center portion is surrounded by said N surfaces of said first piece and such that said center portion is substantially perpendicular to each of said N surfaces of said first piece;

iii. connecting structure means connecting said flange and said center portion, said connecting structure means having N sides, each one of said N sides connecting one side of said flange with said center portion; and iv. at least N nibs, at least one of said nibs being oriented on each of said N sides of said connecting structure means, for retaining in suitable engaged relation said extension tabs of said first piece of plastic, at least one said nib being oriented for retaining each of said extension tabs;

wherein said first and second pieces of plastic, when in engaged relation respectively form the N sides and a bottom of a container, said bottom being formed by said second piece of plastic and said N sides of said container being formed by said first piece of plastic, said bottom being adapted to be easily attached to said N sides in engaged relation by inserting said connecting structure means of said second piece of plastic into engagement with said N extension tabs until at least two of said extension tabs are securely retained by at least two of said nibs, said engagement resulting in a container wherein said bottom of said container can only be disassembled from said sides with an effort substantially greater than the effort required to insert said bottom into engagement with said sides of said container.

17. The plastic container of claim 16 wherein:

a. said first piece of plastic further comprises:

2N extension tabs, two each of said 2N extension tabs extending from each one of said N surfaces, said two extension tabs extending from each said surface each extending from opposite edges of said surface;

and wherein said plastic container further comprises:

b. a third piece of plastic, said third piece being substantially identical to said second piece of plastic;

wherein said first, second and third pieces of plastic, when in engaged relation respectively from the N sides, a bottom and a top of the container, said N sides being formed by said first piece of plastic, said bottom and top being identical and being interchangeably formed by said second piece of plastic and said third piece of plastic, said bottom and said top being adapted to be easily attached to said N sides in engaged relation by inserting said connecting structure means of said second piece of plastic and said connecting structure means of said third piece of plastic into engagement with said 2N extension tabs, said second piece of plastic being in engagement with at least two of said N extension tabs, said N extension tabs being the extension tabs all commonly disposed at one end of said first piece of plastic, and said third piece of plastic being in engagement with at least two of said N extension tabs, said N extension tabs being the extension tabs all commonly disposed at a second end of said first piece of plastic, said second piece of plastic and said third piece of plastic each being adapted to be easily attached to said first piece of plastic by inserting said center portion of said second piece of plastic and said center portion of said third piece of plastic each into engagement with at least two of said extension tabs until at least two of said extension tabs are securely retained by at least two of said nibs, said attachment resulting in a structure wherein said bottom and said top of said container can only be disassembled from said sides with an effort substantially greater than the effort required to insert said bottom and said top into engagement with said sides of said container.

18. The plastic container of claim 16, wherein each of said extension tabs extending from said plurality of surfaces extends therefrom at an angle, said angle being denominated as angle A, wherein each of said tabs extends substantially at angle A in a direction such that in the assembled condition of the container, all of said extension tabs are bent at angle A in an inward direction all towards each other, wherein said connecting structure extends from said flange at an angle B, wherein angle A is larger than angle B by an amount suitable to provide for snap retention of said extension tabs by said nibs located on said connecting structure when said second piece is inserted into said first piece to a distance sufficient such that said extension tabs are in engaged relation with said connecting structure and are retained by said nibs.

* * * * *

UNITED STATES PATENT OFFICE

CERTIFICATE OF CORRECTION

Patent No. 3,941,300 Dated March 2, 1976

Inventor(s) John S. Troth

It is certified that error appears in the above-identified patent and that said Letters Patent are hereby corrected as shown below:

Column 5, Lines 30-31, "extrusion" should be --extension--.

Column 8, Line 22, "an" should be --a--.

Column 8, Line 23, "ana" should be --an--.

Signed and Sealed this

*first* Day of *June 1976*

[SEAL]

*Attest:*

RUTH C. MASON
*Attesting Officer*

C. MARSHALL DANN
*Commissioner of Patents and Trademarks*